US011358158B2

(12) United States Patent
Ye et al.

(10) Patent No.: US 11,358,158 B2
(45) Date of Patent: Jun. 14, 2022

(54) FLEXIBLE SPRAY NOZZLE SPRAYER FACE CAP

(71) Applicant: NINGBO DAYE GARDEN INDUSTRY CO., LTD., Zhejiang (CN)

(72) Inventors: Xiaodong Ye, Ningbo (CN); Fei Gong, Ningbo (CN); Jifeng Huang, Ningbo (CN); Mingming Cao, Ningbo (CN)

(73) Assignee: NINGBO DAYE GARDEN INDUSTRY CO., LTD., Ningbo (CN)

( * ) Notice: Subject to any disclaimer, the term of this patent is extended or adjusted under 35 U.S.C. 154(b) by 0 days.

(21) Appl. No.: 16/929,649

(22) Filed: Jul. 15, 2020

(65) Prior Publication Data

US 2021/0346896 A1 Nov. 11, 2021

(30) Foreign Application Priority Data

May 6, 2020 (CN) ..... 202020715653.9

(51) Int. Cl.
*B05B 1/16* (2006.01)

(52) U.S. Cl.
CPC ..... *B05B 1/1645* (2013.01)

(58) Field of Classification Search
CPC ... B05B 1/1636; B05B 1/1645; B05B 1/1654; B05B 1/18; B05B 1/185
See application file for complete search history.

(56) References Cited

U.S. PATENT DOCUMENTS 5,873,531 A * 2/1999 Wang ..... B05B 1/1654 239/394
6,736,336 B2 * 5/2004 Wong ..... B05B 1/1654 239/440
8,220,726 B2 * 7/2012 Qiu ..... B05B 1/18 239/560

* cited by examiner

*Primary Examiner* — Qingzhang Zhou
(74) *Attorney, Agent, or Firm* — Ladas & Parry, LLP

(57) ABSTRACT

The present invention discloses a novel flexible spray nozzle sprayer face cap, rotatably installed at a head part of a garden water gun, configured to switch sprayed water types and structurally including a water division plate, a spray seat, and a main body sequentially fixed in a coaxial way. The novel flexible spray nozzle sprayer face cap is mainly characterized in that an embedded and fixed flexible spray nozzle is disposed in each water outlet small hole formed in the main body, and an outer end of each of the flexible spray nozzles respectively extends out of the water outlet small hole to be exposed, so that when the sprayer face cap rotates and switches to communicate passing water to a plurality of water outlet small holes, the passing water can be sprayed out from the flexible spray nozzle in each of the water outlet small holes. By designing the flexible spray nozzles, a range outer diameter of the water outlet small holes is increased, and water outlet position navigation of the water outlet small holes is also enhanced by using the flexible spray nozzles, so that the spray range is longer. At the same time, it is convenient to clean blocked impurities by the flexible spray nozzles. For example, when there are fine sandy impurities, the fine sandy impurities can be cleaned away only by slightly pulling the flexible spray nozzles by hand, so that the use quality of the sprayer face cap is greatly improved.

10 Claims, 6 Drawing Sheets

FLEXIBLE SPRAY NOZZLE SPRAYER FACE CAP

CROSS-REFERENCE TO RELATED APPLICATION

The present application claims priority to Chinese Patent Application No. 202020715653.9 filed on May 6, 2020, the disclosure of which is incorporated herein by reference in its entirety.

TECHNICAL FIELD

The present invention relates to a sprayer face cap rotatably installed at a head part of a garden water gun and configured to switch sprayed water types, and more particularly, to a novel flexible spray nozzle sprayer face cap.

RELATED ART

At present, sprayed water types of garden water guns, such as a spray type, a linear type or a water bloom type, are switched by rotating a sprayer face cap installed at a head part of a garden water gun. The sprayer face cap is generally composed of structures such as a water division plate, a spray seat, and a main body sequentially fixed in a coaxial way. A plurality of water division holes are formed in the water division plate, a plurality of water passing structures are disposed on the spray seat, and a plurality of water outlet structures are disposed on the main body. Additionally, the plurality of water division holes are respectively communicated with the plurality of water passing structures in a one-to-one correspondence way, and the plurality of water passing structures are then respectively communicated with the plurality of water outlet structures in a one-to-one correspondence way. At the same time, one of the water outlet structures is formed by a plurality of water outlet small holes. The plurality of water outlet small holes are annularly and densely distributed in an outer end surface of the main body, so that when the sprayer face cap rotates and is switched to spray out water by the plurality of water outlet small holes, water sprayed in a sprinkling type can be formed for a user to use. However, garden water may be mixed with some fine sandy impurities, the particle size of these impurities is small, but the hole diameters of the water outlet small holes are often made smaller to ensure a longer spray range, so the water outlet small holes can be easily blocked by the fine sandy impurities, and the normal water outlet of the water outlet small holes is influenced. The water outlet small holes are directly designed on the main body made of hard plastics, so they are very difficult to clean even if they are blocked by the fine sandy impurities. Finally, the use quality of the whole sprayer face cap is reduced.

SUMMARY

A technical problem to be solved by the present invention is to provide a novel flexible spray nozzle sprayer face cap for increasing a spraying range, bringing convenience to clean impurities blocked in water outlet small holes and improving the use quality of the sprayer face cap by overcoming the defects in the prior art.

The technical problem is solved by the present invention through the following technical solution:

A novel flexible spray nozzle sprayer face cap includes a water division plate, a spray seat, and a main body sequentially fixed in a coaxial way. A plurality of water division holes are formed in the water division plate. A plurality of water passing structures are disposed on the spray seat. A plurality of water outlet structures are disposed on the main body. The plurality of water division holes are respectively communicated with the plurality of water passing structures in a one-to-one correspondence way. The plurality of water passing structures are then respectively communicated with the plurality of water outlet structures in a one-to-one correspondence way. One of the water outlet structures is formed by a plurality of water outlet small holes. The plurality of water outlet small holes are annularly and densely distributed in an outer end surface of the main body. An embedded and fixed flexible spray nozzle is disposed in each of the water outlet small holes. An outer end of each of the flexible spray nozzles respectively extends out of the water outlet small hole to be exposed. One of the water division holes in the water division plate is supplied with water and is communicated with one of the water passing structures on the spray seat. Then, the plurality of water outlet small holes are simultaneously communicated by the water passing structure. The water is sprayed out from the flexible spray nozzle in each of the water outlet small holes.

The water division plate, the spray seat, and the main body are all of a circular disc shape. A flexible rubber coating ring covers the outside of the main body.

Six water division holes are formed in the water division plate. Correspondingly, six water passing structures are disposed on the spray seat. Six water outlet structures are disposed on the main body.

The six water division holes are uniformly and circumferentially distributed by using a circle center of the water division plate as a center.

The six water passing structures are respectively a middle hole formed in a circle center of the spray seat, four side holes circumferentially surrounding the middle hole, and a group of water outlet posts. A flange groove is formed in an inner end surface of the spray seat relative to the water division plate. The flange groove is communicated with the middle hole. An independently sealed water passing cavity is formed between the spray seat and the water division plate. The water passing cavity is communicated with the group of water outlet posts. Four of the water division holes in the six water division holes are respectively communicated with the four side holes in a one-to-one correspondence way. One of the water division holes is communicated with the middle hole through the flange groove. One of the water division holes is jointly communicated with the group of water outlet posts through the water passing cavity.

The six water outlet structures are respectively a bubbling hole disposed in a circle center position of the main body, two water type holes circumferentially surrounding the bubbling hole, a group of spraying holes, an inner ring cavity, and an outer ring cavity. The inner ring cavity and the outer ring cavity are simultaneously disposed on an inner end surface of the main body relative to the spray seat. A plurality of water outlet small holes are formed in the outer ring cavity. A water outlet ring installed in a sealed way is disposed in the bubbling hole. A bubbler installed in a sealed way is disposed in the water outlet ring. A water spraying gap is formed between an outer wall of the water outlet ring and an inner wall of the bubbling hole, and is communicated with the inner ring cavity. The middle hole is communicated with the bubbler in the bubbling hole. Two of the side holes in the four side holes are respectively and directly communicated with the two water type holes in a one-to-one correspondence way. One of the side holes is communicated with the water spraying gap through the inner ring cavity.

One of the side holes is jointly communicated with the flexible spray nozzles in the plurality of water outlet small holes through the outer ring cavity. The group of water outlet posts and the group of spraying holes have the same quantity, and are communicated in a one-to-one correspondence way.

An embedded and fixed flexible ring is disposed in the outer ring cavity. The plurality of flexible spray nozzles are simultaneously formed on the flexible ring in a connected way, and are simultaneously communicated with the outer ring cavity.

The group of water outlet posts refers to six hollow posts of completely identical structures. The six water outlet posts are uniformly and circumferentially distributed by using the middle hole as a circle center. An inner end of each of the water outlet posts is respectively exposed on an inner end surface of the spray seat. An outer end is respectively exposed on an outer end surface of the spray seat. Two water inlet passages are respectively disposed on an outer side surface of the inner end of each of the water outlet posts. The two water inlet passages are symmetrical in positions, and extend in an axial direction. The water passing cavity is communicated with each of the water outlet posts through the two water inlet passages. Two water outlet passages are respectively disposed on an end surface of the outer end of each of the water outlet posts. Water outlet directions of the two water outlet passages are opposite. The outer end of each of the water outlet posts is tightly inserted and disposed in the corresponding spraying hole, and then is communicated with the spraying holes through the two water outlet passages.

The group of spraying holes refers to six through holes of completely identical structures. The six spraying holes are uniformly and circumferentially distributed by using the bubbling hole as a circle center.

Six sealing caps are disposed on an outer end surface of the water division plate relative to the spray seat. The six sealing caps are in one-to-one correspondence to the six water outlet posts in positions. Each of the sealing caps covers an inner end of the corresponding water outlet post in a sealed way.

Compared with the prior art, the present invention is mainly characterized in that the embedded and fixed flexible spray nozzle is disposed in each of the water outlet small holes, and the outer end of each of the flexible spray nozzles extends out of the water outlet small hole to be exposed. Therefore, when the sprayer face cap rotates and switches, passing water sequentially passes through one of the water division holes on the water division plate and one of the water passing structures on the spray seat to be simultaneously communicated with the plurality of water outlet small holes, and the water can be sprayed out from the flexible spray nozzle in each of the water outlet small holes. By designing the flexible spray nozzles, a range outer diameter of the water outlet small holes is increased, and water outlet position navigation of the water outlet small holes is also enhanced by using the flexible spray nozzles, so that the spray range becomes longer. At the same time, it is convenient to clean blocked impurities by the flexible spray nozzles. For example, when there are fine sandy impurities, the fine sandy impurities can be cleaned away only by slightly pulling the flexible spray nozzles by hand, so that the use quality of the sprayer face cap is greatly improved.

DETAILED DESCRIPTION

The embodiments of the present invention are further described in detail below with reference to the foregoing accompanying drawings.

As shown in FIG. 1 to FIG. 6, 1 denotes a water division plate, 11 denotes a water division hole, 12 denotes a sealing cap, 2 denotes a spray seat, 21 denotes a flange groove, 22 denotes a water passing cavity, 3 denotes a main body, 31 denotes a rubber coating ring, 4 denotes a water passing structure, 41 denotes a middle hole, 42 denotes a side hole, 43 denotes a water outlet post, 431 denotes a water inlet passage, 432 denotes a water outlet passage, 5 denotes a case, 51 denotes a water outlet plug, 52 denotes a screw, 53 denotes a gasket, 6 denotes a flexible spray nozzle, 61 denotes a flexible ring, 7 denotes a water outlet ring, 71 denotes a water spraying gap, 72 denotes a water guide groove, 8 denotes a bubbler, 81 denotes a fixing cap, 82 denotes a sealing ring, 9 denotes a water outlet structure, 91 denotes a water outlet small hole, 92 denotes a water type hole, 93 denotes a spraying hole, 94 denotes a bubbling hole, 95 denotes an inner ring cavity, 96 denotes an outer ring cavity, and 10 denotes a garden water gun.

Figure 6:
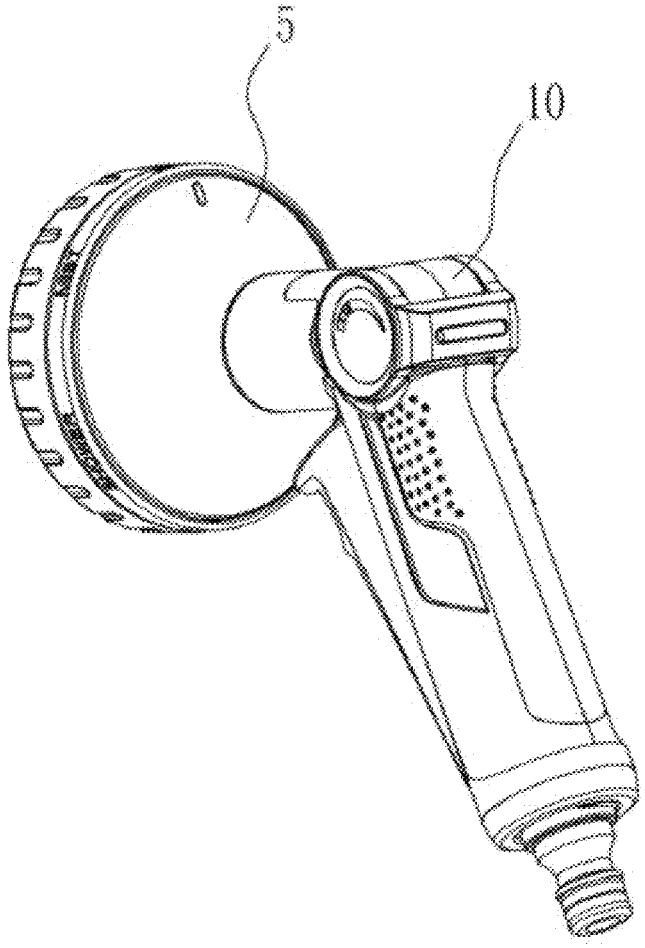
FIG. 6 is a schematic diagram of a structure assembled on a garden water gun.

A novel flexible spray nozzle sprayer face cap, as shown in FIG. 6, may be rotationally installed on the case 5 of a head part of the garden water gun 10 in a sealed way through the screw 52 and the gasket 53 in an axis, and is configured to switch sprayed water types. According to the present embodiment, description is made by regarding the left side of views shown in FIG. 1 and FIG. 2 as an inner end and the right side of the views as an outer end. The novel flexible spray nozzle sprayer face cap is structurally and mainly composed of the water division plate 1, the spray seat 2, and the main body 3 sequentially fixed in a coaxial way. The water division plate 1, the spray seat 2, and the main body 3 are all of a circular disc shape. A flexible rubber coating ring 31 covers the outside of the main body 3 so as to conveniently drive rotation and switching of the whole sprayer face cap.

Figure 1:
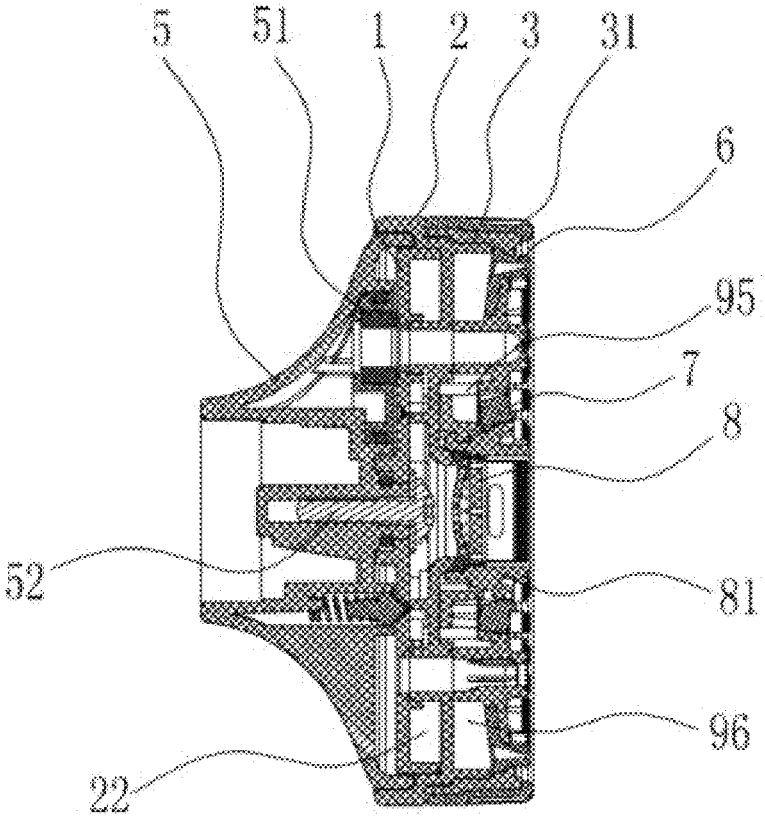
FIG. 1 is a schematic cross-sectional structure diagram of the present invention.
Figure 2:
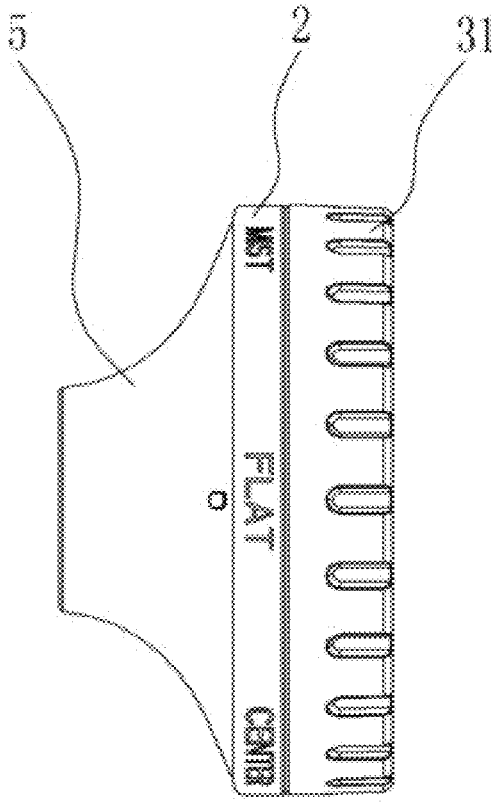
FIG. 2 is a schematic appearance structure diagram of FIG. 1.
Figure 3:
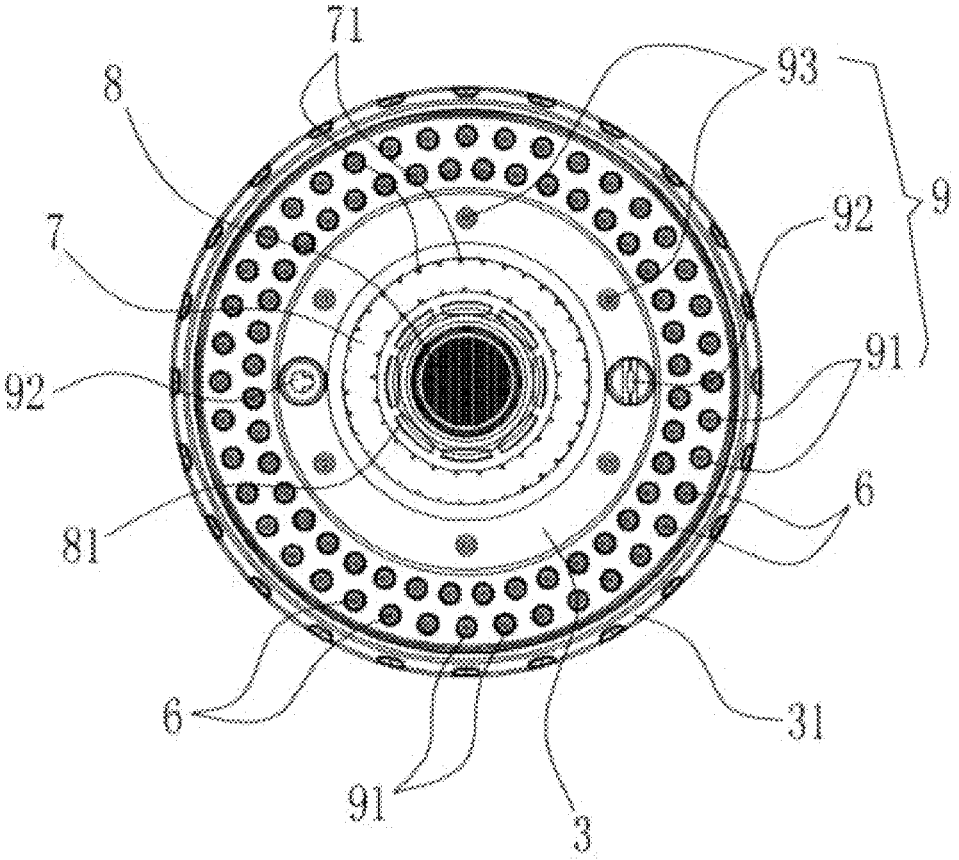
FIG. 3 is a right side view of FIG. 2.
Figure 4:
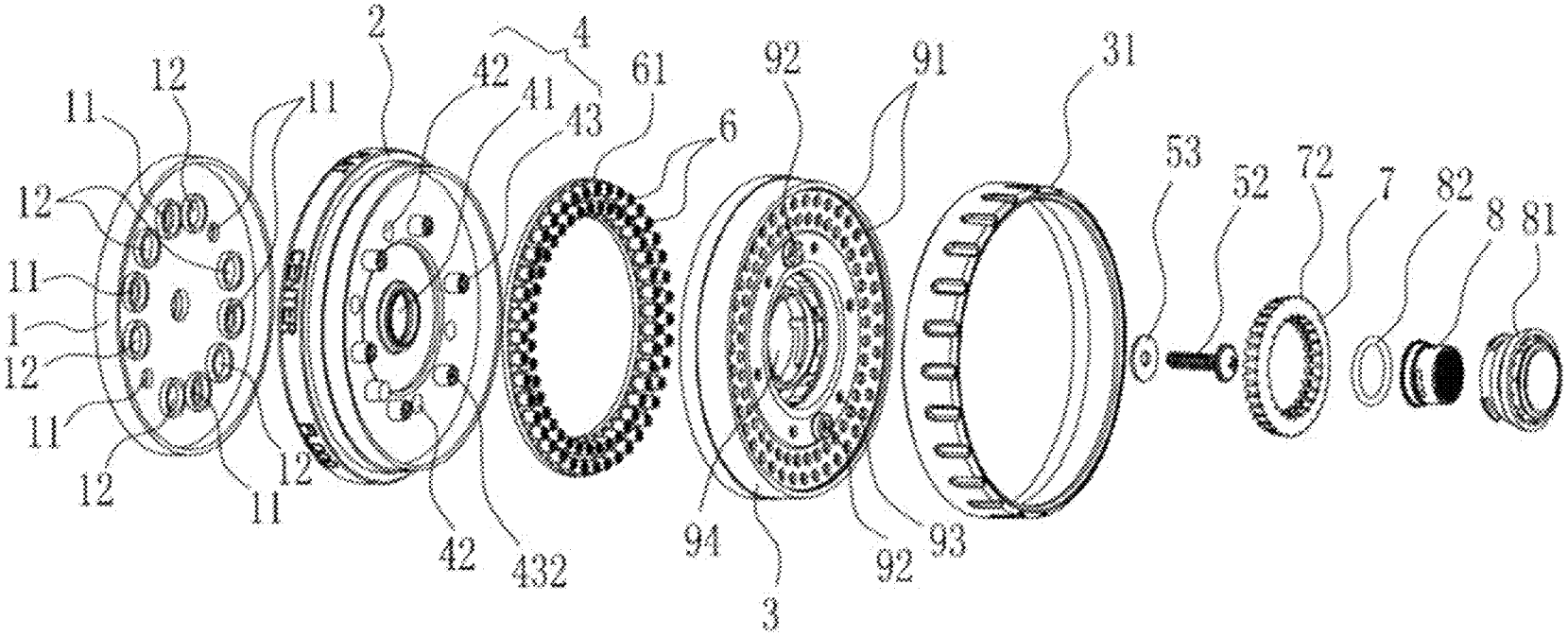
FIG. 4 is an exploded three-dimensional view in one view direction of FIG. 2.
Figure 5:
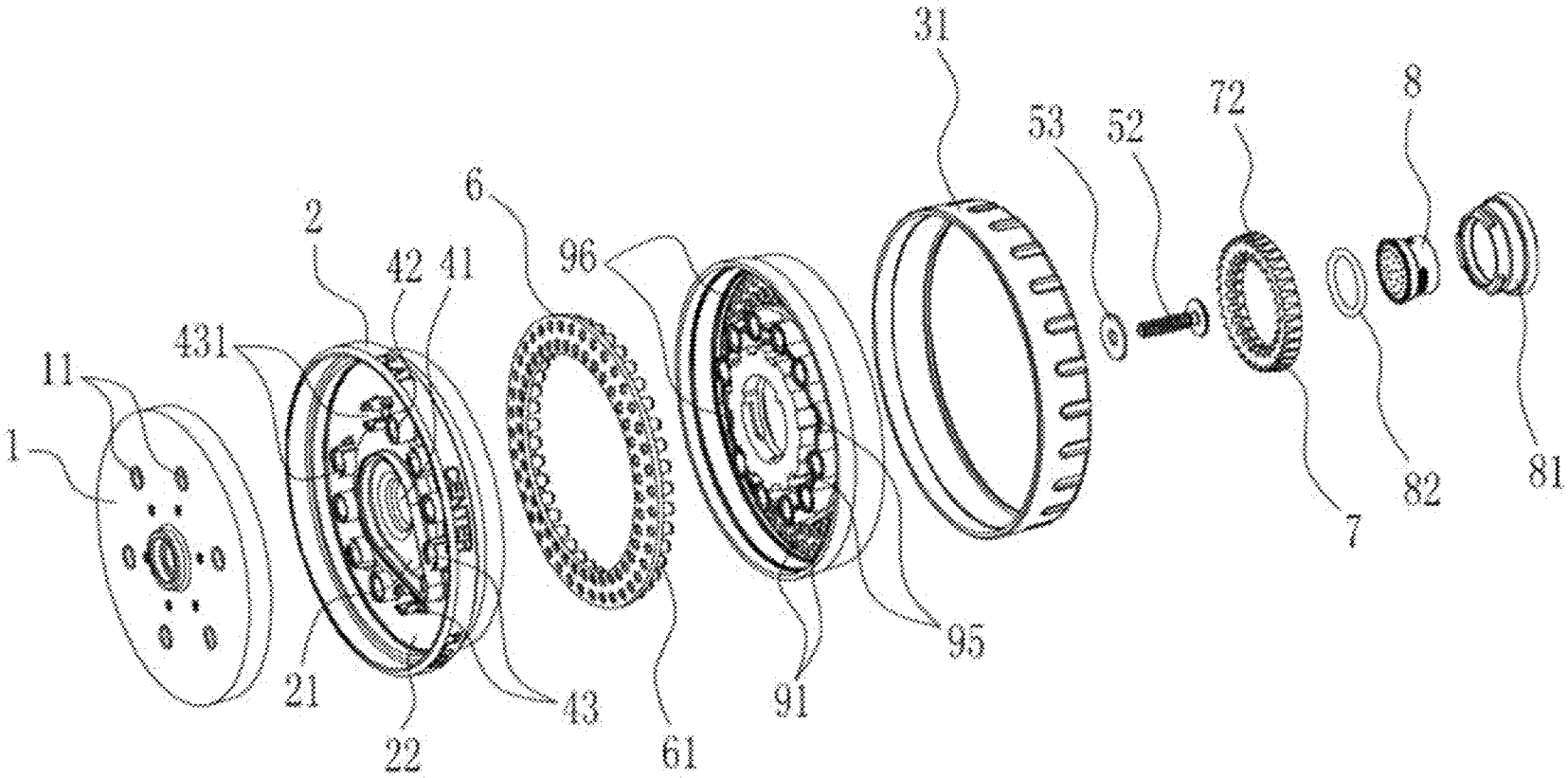
FIG. 5 is an exploded three-dimensional view in another view direction of FIG. 2.

A plurality of water division holes 11 are formed in the water division plate 1. The quantity of the water division holes is selected according to practical use requirements. According to the present embodiment, as shown in FIG. 4 and FIG. 5, six uniformly and circumferentially distributed water division holes are formed by using a circle center of the water division plate 1 as a center.

A plurality of water passing structures 4 are disposed on the spray seat 2. The quantity of the plurality of water passing structures needs to be the same as the quantity of the plurality of water division holes 11, so that the plurality of water division holes 11 can be respectively communicated with the plurality of water passing structures 4 in a one-to-one correspondence way. According to the present embodiment, as shown in FIG. 4 and FIG. 5, six water passing structures 4 need to be disposed on the spray seat 2.

Additionally, the six water passing structures 4 are respectively the middle hole 41 formed in a circle center of the spray seat 2, four side holes 42 circumferentially surrounding the middle hole 41, and a group of water outlet posts 43.

The flange groove 21 is formed in an inner end surface of the spray seat 2. The flange groove is communicated with the middle hole 41. The four side holes 42 are practically characterized in that two side holes form one group, and then, the two groups of side holes are symmetrically distributed by using the middle hole 41 as a center. In the present embodiment, the group of water outlet posts 43 refers to six hollow posts of completely identical structures. The six water outlet posts are uniformly and circumferentially distributed by using the middle hole 41 as a circle center. An inner end of each of the water outlet posts 43 is respectively exposed on an inner end surface of the spray seat 2, i.e., the left end surface of the spray seat 2 shown in FIG. 4 and FIG. 5. An outer end is respectively exposed on the outer end surface of the spray seat 2, i.e., the right end surface of the spray seat 2 shown in FIG. 4 and FIG. 5. Two water inlet passages 431 are respectively disposed on an outer side surface of the inner end of each of the water outlet posts 43. The two water inlet passages are symmetrical in positions, and extend in an axial direction. Two water outlet passages 432 are respectively disposed on an end surface of the outer end of each of the water outlet posts 43. Water outlet directions of the two water outlet passages are opposite.

An independently sealed water passing cavity 22 is formed between the spray seat 2 and the water division plate 1. The water passing cavity is communicated with each of the water outlet posts 43 through the two water inlet passages 431. That is, the water passing cavity 22 is simultaneously communicated with the group of water outlet posts 43. Additionally, six sealing caps 12 corresponding to the water outlet posts 43 in positions are disposed on an outer end surface of the water division plate 1 relative to the spray seat 2. Each of the sealing caps covers an inner end of the corresponding water outlet post 43 in a sealed way, so that each of the water outlet posts 43 can form an independent water supply passage.

Four of the water division holes in the six water division holes 11 are respectively and directly communicated with the four side holes 42 in a one-to-one correspondence way. One of the water division holes 11 is communicated with the middle hole 41 through the flange groove 21. One of the water division holes 11 is jointly communicated with the group of water outlet posts 43 through the water passing cavity 22.

A plurality of water outlet structures 9 are disposed on the main body 3. The quantity of the plurality of water outlet structures needs to be the same as the quantity of the plurality of water passing structures 4. Therefore, the plurality of water passing structures 4 can be respectively communicated with the plurality of water outlet structures 9 in a one-to-one correspondence way. According to the present embodiment, as shown in FIG. 4, six water outlet structures 9 needs to be disposed on the main body 3.

Additionally, the six water outlet structures 9 are respectively the bubbling hole 94 disposed in a circle center of the main body 3, two water type holes 92 circumferentially surrounding the bubbling hole 94, a group of spraying holes 93, an inner ring cavity 95, and an outer ring cavity 96. The inner ring cavity and the outer ring cavity are simultaneously disposed on an inner end surface of the main body 3 relative to the spray seat 2, i.e., the left end surface of the main body 3 shown in FIG. 4. The inner and outer ring cavities and the bubbling hole 94 are concentric. Additionally, the inner ring cavity 95 surrounds the bubbling hole 94. The outer ring cavity 96 surrounds the inner ring cavity 95.

The water outlet ring 7 installed in a sealed way is disposed in the bubbling hole 94. The water outlet ring is a conical ring with a bigger inner side and a smaller outer side. The bubbler 8 installed in a sealed way by the fixing cap 81 and the sealing ring 82 is disposed in the water outlet ring 7. A plurality of uniformly and circumferentially distributed water guide grooves 72 are formed in an outer wall of the water outlet ring 7. Each of the water guide grooves penetrates in the axial direction of the water outlet ring 7, so that the water spraying gap 71 can be formed between the outer wall of the water outlet ring 7 and an inner wall of the bubbling hole 94 through the water guide grooves 72. The water spraying gap is communicated with the inner ring cavity 95.

The middle hole 41 is communicated with the bubbler 8 in the bubbling hole 94 to discharge water. Two of the side holes in the four side holes 42 are respectively and directly communicated with the two water type holes 92 in a one-to-one correspondence way. That is, the water types of determined bloom styles can be directly sprayed out. One of the side holes 42 is communicated with the water spraying gap 71 through the inner ring cavity 95. One of the side holes 42 is communicated with the outer ring cavity 96. The group of water outlet posts 43 and the group of spraying holes 93 have the same quantity, and are communicated in one-to-one correspondence way. The group of spraying holes 93 refers to six through holes of completely identical structures. The six spraying holes 93 are uniformly and circumferentially distributed by using the bubbling hole 94 as a circle center. Therefore, only by tightly inserting and disposing the outer end of each of the water outlet posts 43 in the corresponding spraying hole 93, the outer end of each of the water outlet posts can be communicated with the spraying holes 93 through the two water outlet passages 432 to spray out big spray type outlet water.

Additionally, a plurality of water outlet small holes 91 are formed in the outer ring cavity 96. The plurality of water outlet small holes 91 reflecting on an outer end surface of the main body 3 are annularly and densely distributed. The embedded and fixed flexible spray nozzle 6 is disposed in each of the water outlet small holes 91. According to a specific structure, the embedded and fixed flexible ring 61 is disposed in the outer ring cavity 96. The plurality of flexible spray nozzles 6 are simultaneously formed on the flexible ring 61 in a connected way, and are simultaneously communicated with the outer ring cavity 96.

Therefore, one of the side holes 42 can be jointly communicated with the flexible spray nozzles 6 in the plurality of water outlet small holes 91 through the outer ring cavity 96. That is, one of the water division holes 11 in the water division plate 1 is supplied with water and is communicated with the corresponding side hole 42 on the spray seat 2, and then is communicated with the corresponding outer ring cavity 96 through this side hole. Therefore, the plurality of water outlet small holes 91 are simultaneously communicated. The water can be sprayed out from the flexible spray nozzle 6 in each of the water outlet small holes.

Particularly, according to the present embodiment, the outer end of each of the flexible spray nozzles 6 extends out of the water outlet small hole 91 at equal intervals to be exposed. The objective is that by designing the flexible spray nozzles 6 of such a structure, a range outer diameter of the water outlet small holes 91 is increased, and water outlet position navigation of the water outlet small holes 91 is also enhanced by using the flexible spray nozzles 6, so that the spray range is longer.

The present invention totally has six water outlet gears for use. A work process is as follows: along with rotation and switching of the sprayer face cap, the six water division holes 11 in the water division plate 1 are communicated with the water outlet plugs 51 on the case 5 one by one. Two of the water division holes 11 can be directly communicated with two corresponding water type holes 92 through corresponding side holes 42 so as to spray out the water types of the determined bloom styles. One of the water division holes 11 is communicated with the middle hole 41 through the flange groove 21, and then, the water is sprayed out from the bubbler 8. One of the water division holes 11 is simultaneously communicated with the group of water outlet posts 43 through the water passing cavity 22, the water outlet posts are then communicated with the group of spraying holes 93 in one-to-one correspondence to spray out big spray type outlet water. One of the water division holes 11 is communicated with the inner ring cavity 95 through the corresponding side hole 42, and then, the water is sprayed out from the water spraying gasp 71. One of the water division holes 11 is communicated with the outer ring cavity 96 through the corresponding side hole 42, and then, the water is simultaneously sprayed out from the flexible spray nozzle 6 in each of the water outlet small holes 91.

The foregoing descriptions are merely specific embodiments of the present invention, and a person skilled in the art should understand that any structural design equivalent to the embodiments shall fall within the protection scope of the present invention.

What is claimed is:

1. A flexible spray nozzle sprayer face cap, comprising:

a water division plate, a spray seat, and a main body sequentially fixed in a coaxial way, wherein the water division plate comprises a plurality of water division holes, the spray seat comprises a plurality of water passing structures, and the main body comprises a plurality of water outlet structures;

the plurality of water division holes are configured to respectively communicate with the plurality of water passing structures, the plurality of water passing structures are configured to respectively communicate with the plurality of water outlet structures, one of the plurality of water outlet structures comprises a plurality of water outlet small holes, the plurality of water outlet small holes are annularly distributed in an outer end surface of the main body, wherein an embedded and fixed flexible spray nozzle is disposed in each of the plurality of water outlet small holes, and an outer end of each of the flexible spray nozzles is configured to extend out of the water outlet small hole; and one of the plurality of water division holes in the water division plate is configured to supply water and to communicate with one of the water passing structures on the spray seat, and the water passing structure is configured to communicate with the plurality of water outlet small holes, and the water is configured to spray out from the flexible spray nozzle in each of the plurality of water outlet small holes;

wherein the water outlet structures comprise a bubbling hole disposed in a circle center of the main body, water type holes circumferentially surrounding the bubbling hole, a group of spraying holes, an inner ring cavity, and an outer ring cavity;

the inner ring cavity and the outer ring cavity are disposed on an inner end surface of the main body opposite to the spray seat, and a plurality of water outlet small holes are formed in the outer ring cavity;

a sealed water outlet ring is disposed in the bubbling hole, a sealed bubbler is disposed in the water outlet ring, a water spraying gap is formed between an outer wall of the water outlet ring and an inner wall of the bubbling hole and is configured to communicate with the inner ring cavity; and a middle hole is configured to communicate with the bubbler, at least one of the side holes is configured to communicate with the water type holes, one of the side holes is configured to communicate with the water spraying gap through the inner ring cavity, and one of the side holes is configured to communicate with the flexible spray nozzles in the plurality of water outlet small holes through the outer ring cavity; and a group of water outlet posts is configured to communicate with the group of spraying holes respectively.

2. The flexible spray nozzle sprayer face cap according to claim 1, wherein the water division plate, the spray seat, and the main body are configured to be in a circular disc shape, wherein a flexible rubber coating ring is configured to cover outside of the main body.

3. The flexible spray nozzle sprayer face cap according to claim 1, wherein six water division holes are formed in the water division plate, six water passing structures are disposed on the spray seat, and six water outlet structures are disposed on the main body.

4. The flexible spray nozzle sprayer face cap according to claim 1, wherein the plurality of water division holes are uniformly and circumferentially distributed with a circle center of the water division plate as a center.

5. The flexible spray nozzle sprayer face cap according to claim 1, wherein the plurality of water passing structures comprises a middle hole formed in a circle center of the spray seat, side holes circumferentially surrounding the middle hole, and a group of water outlet posts;

a flange groove is formed in an inner end surface of the spray seat opposite to the water division plate, and the flange groove is configured to communicate with the middle hole;

an independent sealed water passing cavity is formed between the spray seat and the water division plate, and the water passing cavity is configured to communicate with the group of water outlet posts; and at least one of the plurality of the water division holes is configured to communicate with the side holes, one of the plurality of water division holes is configured to communicate with the middle hole through the flange groove, and one of the plurality of water division holes is configured to communicate with the group of water outlet posts through the water passing cavity.

6. The flexible spray nozzle sprayer face cap according to claim 1, wherein an embedded and fixed flexible ring is disposed in the outer ring cavity, and the plurality of flexible spray nozzles are formed on the flexible ring, and are configured to communicate with the outer ring cavity.

7. The flexible spray nozzle sprayer face cap according to claim 5, wherein the group of water outlet posts comprises a plurality of hollow posts, the water outlet posts are uniformly and circumferentially distributed with the middle hole as a circle center, an inner end of each of the water outlet posts is respectively exposed on an inner end surface of the spray seat, an outer end is respectively exposed on an outer end surface of the spray seat, two water inlet passages are respectively disposed on an outer side surface of the inner end of each of the water outlet posts, the two water inlet passages are symmetrical in positions, and extend in an axial direction, and the water passing cavity is configured to communicate with each of the water outlet posts through the two water inlet passages; and two water outlet passages are respectively disposed on an end surface of the outer end of each of the water outlet posts, water outlet directions of the two water outlet passages are opposite to each other, and the outer end of each of the water outlet posts is tightly inserted and disposed in a corresponding spraying hole, and is configured to communicate with the spraying holes through the two water outlet passages.

8. The flexible spray nozzle sprayer face cap according to claim 1, wherein the group of spraying holes comprises a plurality of through holes, and the spraying holes are uniformly and circumferentially distributed with the bubbling hole as a circle center.

9. The flexible spray nozzle sprayer face cap according to claim 1, wherein a plurality of sealing caps are disposed on an outer end surface of the water division plate opposite to the spray seat, the positions of the sealing caps are configured to correspond to the positions of the six water outlet posts respectively, and each of the sealing caps is configured to cover an inner end of the corresponding water outlet post in a sealed way.

10. A flexible spray nozzle sprayer face cap, comprising:

a water division plate, a spray seat, and a main body sequentially fixed in a coaxial way, wherein the water division plate comprises a plurality of water division holes, the spray seat comprises a plurality of water passing structures, and the main body comprises a plurality of water outlet structures;

the plurality of water division holes are configured to respectively communicate with the plurality of water passing structures, the plurality of water passing structures are configured to respectively communicate with the plurality of water outlet structures, one of the plurality of water outlet structures comprises a plurality of water outlet small holes, the plurality of water outlet small holes are annularly distributed in an outer end surface of the main body, wherein an embedded and fixed flexible spray nozzle is disposed in each of plurality of water outlet small holes, and an outer end of each of the flexible spray nozzles is configured to extend out of the water outlet small hole; and one of the plurality of water division holes in the water division plate is configured to supply water and to communicate with one of the water passing structures on the spray seat, and the water passing structure is configured to communicate with the plurality of water outlet small holes, and the water is configured to spray out from the flexible spray nozzle in each of the plurality of water outlet small holes;

wherein the plurality of water passing structures comprises a middle hole formed in a circle center of the spray seat, side holes circumferentially surrounding the middle hole, and a group of water outlet posts;

a flange groove is formed in an inner end surface of the spray seat opposite to the water division plate, and the flange groove is configured to communicate with the middle hole;

an independent sealed water passing cavity is formed between the spray seat and the water division plate, and the water passing cavity is configured to communicate with the group of water outlet posts; and at least one of the plurality of the water division holes is configured to communicate with the side holes, one of the plurality of water division holes is configured to communicate with the middle hole through the flange groove, and one of the plurality of water division holes is configured to communicate with the group of water outlet posts through the water passing cavity;

wherein the group of water outlet posts comprises a plurality of hollow posts, the water outlet posts are uniformly and circumferentially distributed with the middle hole as a circle center, an inner end of each of the water outlet posts is respectively exposed on an inner end surface of the spray seat, an outer end is respectively exposed on an outer end surface of the spray seat, two water inlet passages are respectively disposed on an outer side surface of the inner end of each of the water outlet posts, the two water inlet passages are symmetrical in positions, and extend in an axial direction, and the water passing cavity is configured to communicate with each of the water outlet posts through the two water inlet passages; and two water outlet passages are respectively disposed on an end surface of the outer end of each of the water outlet posts, water outlet directions of the two water outlet passages are opposite to each other, and the outer end of each of the water outlet posts is tightly inserted and disposed in a corresponding spraying hole, and is configured to communicate with the spraying holes through the two water outlet passages.

* * * * *